United States Patent [19]

Kato et al.

[11] 4,184,467

[45] Jan. 22, 1980

[54] CONTACTLESS IGNITION SYSTEM FOR INTERNAL COMBUSTION ENGINE

[75] Inventors: Minoru Kato; Masao Nagasawa, both of Kariya, Japan

[73] Assignee: Nippondenso Co., Ltd., Kariya, Japan

[21] Appl. No.: 905,436

[22] Filed: May 12, 1978

[30] Foreign Application Priority Data

Jul. 30, 1977 [JP] Japan ..... 52-92039

[51] Int. Cl.[2] ..... F02P 1/00

[52] U.S. Cl. ..... 123/148 E; 123/148 CA; 123/148 CB; 315/209 CD

[58] Field of Search ..... 123/148 E, 148 CB, 148 CC, 123/148 ND, 148 F, 148 CA; 315/209 CD

[56] References Cited

U.S. PATENT DOCUMENTS

| | | | |
|---|---|---|---|
| 3,596,133 | 7/1971 | Warren et al. | 315/209 CD |
| 3,861,373 | 1/1975 | Allwang et al. | 315/209 CD |
| 4,034,731 | 7/1977 | Sato | 123/148 E |
| 4,090,488 | 5/1978 | Ohki et al. | 123/148 E |

*Primary Examiner*—Charles J. Myhre
*Assistant Examiner*—R. A. Nelli
*Attorney, Agent, or Firm*—Cushman, Darby & Cushman

[57] ABSTRACT

A contactless ignition system for an internal combustion engine in which a moderately rising timing signal and a steeply rising auxiliary signal are generated so that an auxiliary thyristor is triggered by the auxiliary signal to be conductive to render a main thyrister which is connected in series with the auxiliary thyristor to be conductive by the timing signal and in which a resistor for holding the auxiliary thyristor in the conductive state is connected in parallel with the main thyristor so that the ignition timing in the high speed range may be controlled by the auxiliary signal to prevent the excessive spark timing advance in the high speed range and also in the low speed range the auxiliary thyristor may be maintained in the conductive state until the main thyristor is made conductive to thereby prevent misfiring.

4 Claims, 4 Drawing Figures

CONTACTLESS IGNITION SYSTEM FOR INTERNAL COMBUSTION ENGINE

FIELD OF THE INVENTION

The present invention relates to a contactless ignition system having as an electric source a permanent magnet generator.

BACKGROUND OF THE INVENTION

Conventionally, to enhance engine performance, spark timing advance with increase of the engine rotational speed has been generally practiced, for instance, by using a permanent magnet generator as an electric source, in which, however, only a continuous spark advance can be attained.

In such a system as has a continuous spark advancing function, however, there has been experienced a problem of an excessive spark advance in a high speed range which may cause engine over-heating.

SUMMARY OF THE INVENTION

In order to solve the above problem, the present invention provides a contactless ignition system for an internal combustion engine in which a moderately rising timing signal and a steeply rising auxiliary signal are generated so that an auxiliary thyristor is triggered by the auxiliary signal to be conductive to render a main thyristor which is connected in series with the auxiliary thyristor to be conductive by the timing signal and in which a resistor for holding the auxiliary thyristor in the conductive state is connected in parallel with the main thyristor so that the ignition timing in the high speed range may be controlled by the auxiliary signal to prevent the excessive spark timing advance in the high speed range and also in the low speed range the auxiliary thyristor may be maintained in the conductive state until the main thyristor is made conductive to thereby prevent misfiring.

The present invention will be hereinafter described with reference to the embodiment shown in the attached drawings.

DETAILED DESCRIPTION

Figure 1:
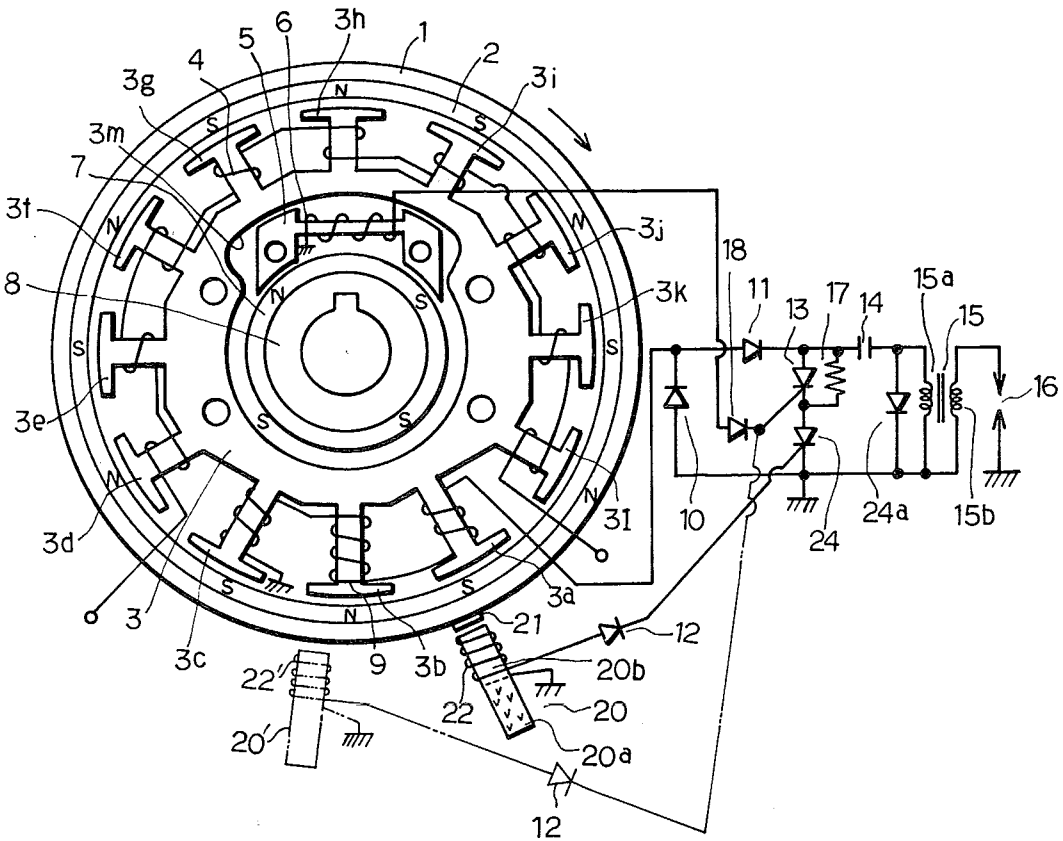
FIG. 1 is a diagrammatic view of apparatus provided in accordance with principles of the present invention.

In FIG. 1, numeral 1 is a cup-shaped rotor, 2 is a ringshaped main magnet secured to the inner surface of the rotor 1, which, as shown in the drawing, is magnetized to form twelve poles alternatively north, N, and south, S, poles spaced at equal intervals. 3 is a ring shaped stator core, the periphery of which is formed with twelve projecting portions 3*a* through 3*l*, of which each of the projecting portions 3*d* through 3*l* is made shorter in the radial direction than three adjoining projecting portions 3*a* through 3*c*. The outermost portion of the portions 3*a* through 3*l* face the main magnet approximately in the same circumference. In the interior of the stator core 3 where the projecting portions 3*g* through 3 *i* are formed to oppose the three projecting portions 3*a* through 3*c*, a recess 3*m* is formed. 4 is a coil winding for lamps, forming an electric power source, which is wound on each of the shorter projecting portions 3*d* through 3*l* and connected in series with each other. 5 is a U-shaped timing core, which is disposed in the recess 3*m* in the same plane as the stator core and is secured to a side wall of an internal combustion engine. 6 is a main signal coil wound on the intermediate portion of the timing core 5. 7 is a ring-shaped magnet for ignition timing, magnetized to have four poles of N, S, S, S in the order named and spaced at equal intervals as shown in the drawing. 8 is a boss secured to the engine crank shaft by bolts not shown, to the periphery of which is secured said permanent magnet 7 for ignition timing. Also to the boss 8, is secured the rotor 1 by rivets not shown. 20 is a pick-up for auxiliary signals secured to a side wall of the internal combustion engine, which comprises an axially magnetized permanent magnet 20*a*, a couple of cores 20*b* respectively secured to the axially upper and lower ends of the magnet 20*a*, and an auxiliary signal coil 22 wound on the both cores 20*b* and connected in series with each other. 21 is a projection of magnetic material. At the position facing the projection 21, there are provided both the cores 20*b* so that when the projection 21 faces the cores 20*b*, an output signal having a steep rising portion in a short period is generated in the auxiliary signal coil 22 as shown by a solid line in FIG. 2 at (*d*). 9 is a capacitor charging coil wound on the longer projecting portions 3*a*, 3*b* and 3*c* and connected in series with each other. 10 is a diode for short-circuiting the half wave with the poles reversly connected in parallel with the capacitor charging coil 9. 11, 12 and 18 are respectively rectifying diodes. 13 is a main thyristor. 14 is a capacitor. 15 is a ignition coil. 15*a* is its primary coil. 15*b* is its secondary coil. 16 indicates a spark plug connected to the secondary side of the ignition coil 15 and disposed in a cylinder of the internal combustion engine. 24 is an auxiliary thyristor having a gate and cathode, across which the auxiliary signal coil 22 is connected. 17 is a resistor for conducting a holding current connected across the anode and cathode of the main thyristor. Both the main magnet 2 and timing magnet 7 are permanent magnets.

Figure 2:
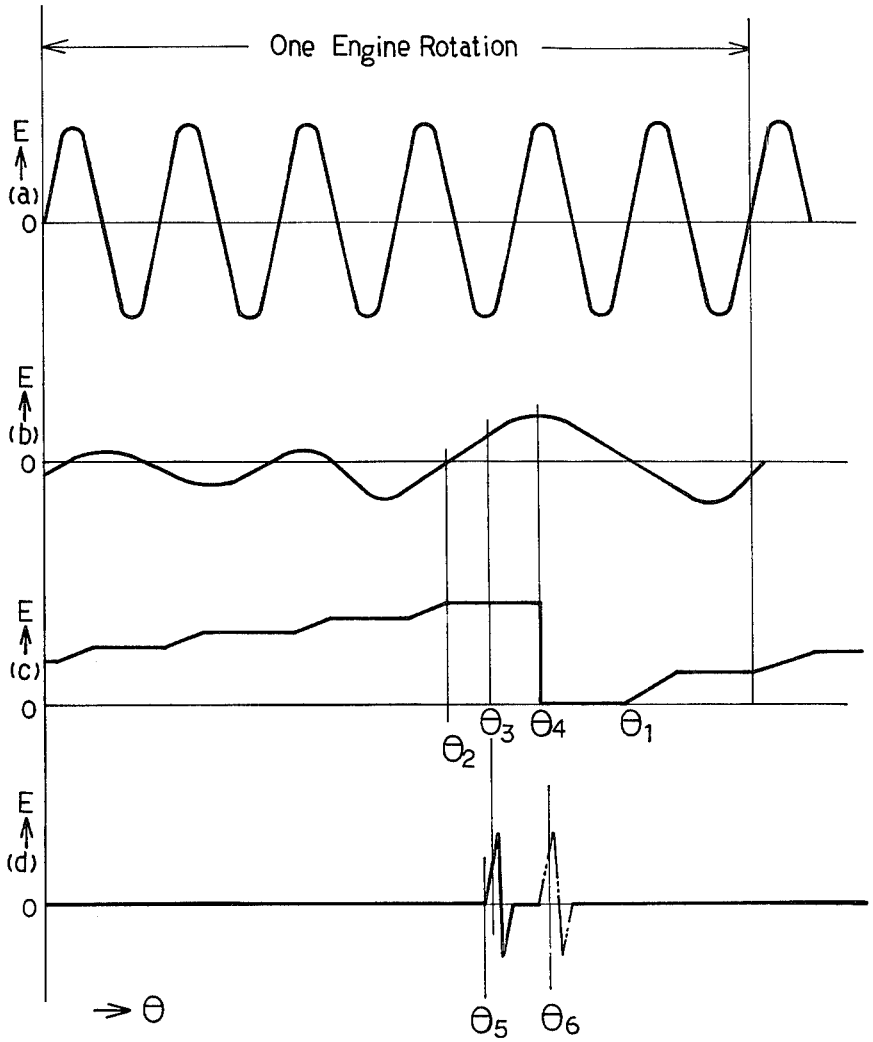
FIG. 2 is a series of four plots illustrating the functioning of the apparatus of FIG. 1.

Next will be explained the operation of the above-constructed device according to the present invention. For each rotation of the internal combustion engine, the boss 8 and rotor 1 make one turn in the direction of an arrow shown in FIG. 1 so that the magnetic flux of the main magnet 2 causes the capacitor charging coil 9 and lamp coil 4 to generate an ac output voltage of six cycles in one rotation, as shown in FIG. 2 at (*a*), so that the magnetic flux of the timing magnet 7 causes the main signal coil 6 to generate a comparatively broad output voltage, in other words, a voltage the rising angle of which increases as the engine rotation increases as shown in FIG. 2 at (*b*), and so that the projection 21 causes the auxiliary signal coil 22 to generate, as shown in FIG. 2 at (*d*), an ac output voltage having a steep rising angle in a cycle per rotation with the rising point being retarded behind the main signal coil 6 within a range where at least a portion thereof is overlapped with the main signal output voltage. When the voltage generated by the capacitor charging coil 9 rises in the positive direction at angle $\theta_1$ shown in FIG. 2 the capacitor charging coil 9 charges the capacitor 14 with its output stepwise through the diode 11 - capacitor 14 - the primary coil 15*a* of the ignition coil 15 - the ground.

At a low engine speed, when a positive voltage is generated by the signal coil 6 from angle $\theta_2$ in FIG. 2, and also a positive voltage is generated by the auxiliary signal coil 22 from angle $\theta_5$ in FIG. 2, a current flows through the auxiliary signal coil 22 - diode 12 - the gate-cathode path of the auxiliary thyristor 24 so that when the output voltage of the auxiliary signal coll 22 reaches a gate-triggering level of the auxiliary thyristor 24, the thyristor 24 is made conductive.

In this case, the auxiliary thyristor 24 is arranged so that the current charged by the capacitor 14 flows from the capacitor 14 - resistor 17 - auxiliary thyristor 24 - primary coil 15*a* of the ignition coil 15, thereby maintaining the auxiliary thyristor in the conductive state even after the gate signal is no longer applied to the auxiliary thyristor 24. For this purpose, the resistance of the resistor 17 is determined so that even after the gate signal of the auxiliary thyristor 24 is diminished, a minimum holding current to keep the anode-cathode path conductive may be ensured. As a result, the capacitor discharging current is so small that any high voltage is induced on the secondary coil of the ignition coil 15 and that the voltage of the charged capacitor 14 may not lower to decrease the ignition spark until the main thyristor 13 is made conductive.

Accordingly, the positive voltage of the main coil 16 generated at the angle $\theta_2$ of FIG. 2 causes the current flow through the main signal coil 6 - diode 18 - the gate-cathode path of the main thyristor 13 - anode-cathode path of the auxiliary thyristor 24 - ground, so that when the output voltage of the main signal coil 6 is generated at the angle $\theta_4$ of FIG. 2 and reaches the gate-triggering level for the thyristor 13, the main thyristor 13 is made conductive through the capacitor 14 - main thyristor 13 - auxiliary thyristor 24 - ground - primary coil of the ignition coil 15 to discharge the capacitor 14 abruptly. As a result, a high voltage is induced in the secondary coil of the ignition coil to cause a spark on the spark plug 16. Here, the diode 24*a* is provided to elongate the arc time.

Next at a high engine speed, the rising angle of the output signal wave of the main signal coil 6 gradually increases with increase of the engine rotation so that the ignition timing advances as increase of the rotation from angle $\theta_4$ shown in FIG. 2 toward angle $\theta_3$. When the timing advances to angle $\theta_3$, the rising angle of the output wave of the auxiliary coil 22 is so steep irrespective of the engine rotation that the output of the auxiliary signal coil 22 does not cause the auxiliary thyristor 24 to be conductive, whereby the timing does not advance and stationary ignition timing is achieved in a higher engine rotation as shown by the solid line in FIG. 3. The above operation is made once in one engine rotation so that an ignition spark generated across a spark plug in a compression stroke fires combustible mixtures to operate the internal combustion engine.

Figure 3:
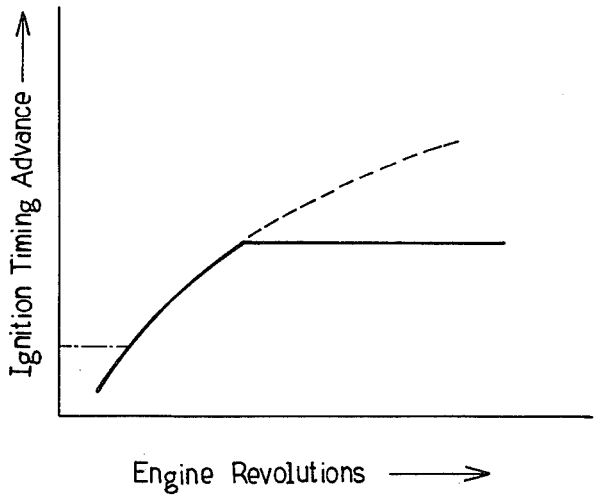
FIG. 3 is a plot comparing the operation of conventional apparatus (dashed line) with that of the present invention (one dot chain line and solid line)

The broken line in FIG. 3 indicates ignition timing characteristics of a conventional device.

In FIG. 1, the low speed pick-up 20′, which is identical in construction with the auxiliary signal pick-up 20, is located about 30 degrees behind the auxiliary signal pick-up 20 in the rotating direction, and the signal coil 22′ of the low speed pick-up 20′ is connected through the diode 12′ to the gate of the thyristor so that an output voltage signal is generated as shown by a two-dot chain line in FIG. 2 at (*d*). As a result, when the engine rotation decreases below a predetermined speed, the output of the signal coil 22′ causes the thyristor 13 to be conductive at angle $\theta_6$ so that the ignition timing in a low speed range below a predetermined speed is fixed as shown by a one-dot chain line in FIG. 3.

In the above embodiment, the cathode of the main thyristor 13 is connected with the anode of the auxiliary thyristor 24 with the cathode of the auxiliary thyristor 24 being grounded so that one end of the main signal coil 6 is grounded. As a result, the output of the main signal coil 6 can be applied across the gate and cathode of the main thyristor 13 and simple connection of the main signal coil 6 is realized.

Figure 4:
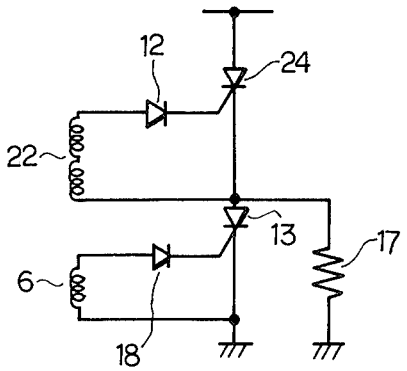
FIG. 4 is a schematic diagram for comparison with a respective portion of FIG. 1, showing a second embodiment of the apparatus of the present invention.

FIG. 4 shows a main portion of another embodiment according to the present invention, in which the anode of the main thyristor 13 is connected with the cathode of the auxiliary thyristor 24 and the main signal coil 6 is connected across the gate and cathode of the main thyristor without the intermediary of the anode-cathode path of the main thyristor 13. As constructed above, the order of connection of the main thyristor 13 and the auxiliary thyristor 24 can be determined more freely than in the embodiment shown in FIG. 1, and the voltage applied to the gate of the main thyristor 13 from the main signal coil is not lowered due to the forward voltage drop of the auxiliary thyristor 24 so that the voltage generated by the main signal coil 6 can be made small to thereby achieve a compact unit.

In the above embodiment, since the output of the auxiliary signal coil 22 and the signal of the main signal coil 6 in combination cause the ignition spark, if the signal of the auxiliary coil 22 is generated once in each engine rotation, a plurality of signals generated by the main signal coil 6 in each engine rotation may be utilized to have a single ignition spark in each engine rotation. In the above embodiment, the spark timing variable signal generating means, which comprises the timing signal core 5 and the signal coil 6 wound around the timing signal core 5, controls the main thyristor 13. However, a transformer for reversing the phase of the half wave which is opposite to the half wave generated by the capacitor charging coil 9 so as to apply it to the gate circuit of the main thyristor 13, or to a zener diode for conducting when the output of the capacitor charging direction or the opposite direction increases above a predetermined value may be used.

In the above embodiment, an electromagnetic arrangement composed of a permanent magnet 20*a* and an auxiliary signal coil 22 is used as an auxiliary signal pick-up, however, it may be composed of a photo-emitting diode and a photo transistor or the like.

In the above embodiment, the present invention is applied to a capacitor discharge contactless ignition system having a permanent magnet generator as an electric source, however, it may be applied to a capacitor discharge contactless ignition system energized by a battery.

As described above, the system according to the present invention comprises a variable ignition timing signal generating means for generating an output voltage the rising angle of which increases with increase of the engine rotation, an auxiliary signal pick-up for generating an output voltage having a steep rising angle which rises behind said variable ignition timing signal so that the output voltage of the auxiliary signal pick-up causes the auxiliary thyristor to be conductive and so that when output voltage higher than the triggering level of the main thyristor is generated the main thyristor is made conductive. Accordingly, in a predetermined speed range of the internal combustion engine, the output of the variable ignition timing generating means can cause the ignition timing to advance with increase of the engine rotation and excessive advance of the ignition timing in the high speed range can be prevented by the output signal of the auxiliary signal pick up to thereby effectively prevent engine over-heating.

Further, since the main and auxiliary thyristors are connected in series with the current holding resistor being connected in parallel with the main thyristor, even when the gate signal is applied only for a short time, the holding current flowing through the above resistor keeps the auxiliary thyristor conductive until the main thyristor is rendered conductive so that at a low speed the conduction of the auxiliary thyristor may be ensured to surely prevent misfiring and so that a compact coil generating steep signals may be used for the auxiliary signal pick-up. Owing to the steep output signals of the auxiliary signal pick-up, the ignition timing at the higher speed range may be advantageously kept constant irrespective of the engine rotation.

We claim:

1. A contactless ignition system for internal combustion engine comprising:

an electric source having an output;

a discharging circuit including:

a capacitor connected to said electric source to be charged by the output of said electric source;

a main thyristor connected to said capacitor and having a gate circuit;

an auxiliary thyristor having a gate circuit, and a primary coil of an ignition coil;

said discharging circuit being arranged for discharging the current charged on said capacitor by conduction of both said thyristors through said primary coil of said ignition coil;

a spark plug connected to a secondary coil of said ignition coil to provide ignition sparks by high voltages generated across said secondary coil;

a resistor connected in parallel with said main thyristor for passing a holding current;

a variable ignition timing signal generating means connected to said gate circuit of said main thyristor for detecting a rotating angle of the internal combustion engine and generating an output voltage, the rising angle of which increases with increase of the engine rotation;

an auxiliary signal pick-up connected to said gate circuit of said auxiliary thyristor for detecting a rotating angle of the internal combustion engine and generating an output voltage having a steep rising angle which rises behind said variable ignition timing signal and which at least partly overlaps with the output voltage of said variable ignition timing signal.

2. A contactless ignition system according to claim 1, wherein:

said main thyristor having a cathode thereof connected to an anode of said auxiliary thyristor so that both said thyristors are connected in series with a cathode of said auxiliary thyristor being grounded; and said variable ignition timing signal generating means and said auxiliary signal pick-up being respectively grounded at respective one ends thereof and being connected to each gate circuit of said thyristors through ground.

3. A contactless ignition system according to claim 1, wherein:

said variable ignition timing signal generating means is connected to the gate circuit of said main thyristor without being connected through the anode-cathode path of said auxiliary thyristor.

4. A contactless ignition system for delivering a series of intermittant pulses of electricity to the ignition coil for an arcing device such as a spark plug, having an intermediate range of operation wherein spark timing advance increases with engine rotational speed, flanked by a lower range of operation in which spark timing advance is maintained relatively more proximate a lower threshold value even though the engine rotational speed further decreases, in order to prevent misfiring, and flanked by an upper range of operation in which spark timing advance is maintained more proximate an upper threshold value even though the engine rotational speed further increases, said system comprising:

an electric generator including associated magnet means and timing core means for producing a series of timing pulses directly proportional in frequency to the engine rotational speed, but moderately rising in relation thereto;

discharging circuit means including main thyristor means for accepting said series of timing pulses, said circuit means being arranged for connecting, via a capacitor means incorporated in said circuit means, with the ignition coil, said main thyristor means being arranged to be changed to a conductive state by acceptance of pulses of said timing pulses;

said generator further including auxiliary pick-up means for producing a series of steeply rising timing signal pulses;

said discharging circuit means further including auxiliary thyristor means connected in series with said main thyristor means and arranged to be changed to a conductive state by receipt of pulses of said steeply rising timing signal pulses;

resistor means connected in parallel in said circuit means with said main thyristor means, for holding said auxiliary thyristor means in the conductive state thereof so that ignition timing in said high speed range may be controlled by said steeply rising timing signal pulses to prevent excessive spark timing advance in said high speed range by maintaining said spark timing advance proximate said upper threshold value, and so that conduction of the auxiliary thyristor means until the main thyristor means is rendered conductive is assured in said low speed range to prevent misfiring in said low speed range;

said generator further including low speed pick-up means for producing a series of timing pulses similar to said series of steeply rising timing signal pulses, but which lags this latter series by about thirty degrees;

said discharging circuit means including means for supplying the resultant lagging series of steeply rising timing signal pulses to said main thyristor means so that when engine speed decreases below a predetermined speed ignition timing is fixed proximate said lower threshold value.

* * * * *